US005891534A

United States Patent [19]

Sabin et al.

[11] Patent Number: 5,891,534

[45] Date of Patent: Apr. 6, 1999

[54] PROTECTIVE RAIL APPARATUS

[75] Inventors: Douglas G. Sabin; David S. McCue, both of Marblehead; Christopher R. Hickey, North Reading, all of Mass.

[73] Assignee: McCue Corporation, Salem, Mass.

[21] Appl. No.: 775,175

[22] Filed: Dec. 31, 1996

[51] Int. Cl.[6] ..... A47F 10/02

[52] U.S. Cl. ..... 428/11; 428/122; 428/358

[58] Field of Search ..... 428/11, 122, 358

[56] References Cited

U.S. PATENT DOCUMENTS

| | | | |
|---|---|---|---|
| D. 249,314 | 9/1978 | Wilde et al. | D8/403 |
| D. 301,953 | 7/1989 | Evenson | D8/403 |
| 325,737 | 9/1885 | Davis | 248/345.1 |
| D. 333,873 | 3/1993 | McCue | D25/38 |
| 355,960 | 1/1887 | Winnek | 248/345.1 |
| 365,225 | 6/1887 | Barrows | 248/345.1 |
| 402,857 | 5/1889 | Robbins et al. | 248/345.1 |
| 1,581,971 | 4/1926 | Mantsion | 248/345.1 |
| 1,754,934 | 4/1930 | Capobianco | 293/17 |
| 2,885,821 | 5/1959 | Frick | 248/345.1 |
| 4,268,097 | 5/1981 | Woodard | 312/137 |
| 5,149,569 | 9/1992 | McCue | 428/31 |

OTHER PUBLICATIONS

CMB Catalog "Protection Rails and Bollards", (10 pages).
Wanzl Catalogue No. 2 Barriers, pp. 2–47.
Cartstop® brochue (6 pages).
Cartstop® brochure (2 pages).

*Primary Examiner*—Henry F. Epstein
*Attorney, Agent, or Firm*—Lahive & Cockfield, LLP

[57] ABSTRACT

Disclosed are improved components for a base rail system for the protection of fixtures such as display shelves, booths, and grocery store refrigeration cabinets. A protruding rotatable corner member rotatably engages objects that collide with the corner, reducing abrasion of the corner and of the object. In addition, the rotatable corner member redirects objects so as to reduce collision forces on the fixture protection system. Socket adapters closely receive a segmented, spheroidal rotatable member and rotatably couple the member to base rail protection members. A base rail protection member includes a single piece arcuate resilient sheath disposed over an arcuate channel member so as to form a cushioning gap therebetween for absorbing and dispersing collision forces. The arcuate sheath includes retaining grooves disposed along the length thereof for engaging tabs disposed along the arcuate channel member. The base rail members are pivotally coupled for adapting to various fixture angles, and for allowing reversal of the base rail protection system. Support means supports the base rail system, including the rotatable corner members and base rail protection members, at a selected height above a floor.

33 Claims, 5 Drawing Sheets

PROTECTIVE RAIL APPARATUS

FIELD OF THE INVENTION

This invention relates to systems for the protection of fixtures and structures from collisions with various objects, such as grocery carts, pallet jacks, and cleaning equipment. More particularly, the invention relates to improved protection members and corner assemblies for a rail-type protection system.

BACKGROUND

Facilities such as malls, airports, train stations, and even smaller establishments such as grocery stores, typically have fixtures, such as display shelves, booths, and counters, that must be accessible, attractive and convenient to the consumer, yet also must be protected from damage from a constant onslaught of customers, not to mention employees, cleaning crews and maintenance personnel. The potential for repeated, costly damage to fixtures from people, some of whom may be relatively unskilled or inattentive, yet operating heavy equipment, is ever present.

A grocery store, for example, often has low, open refrigeration cabinets for display of perishable goods such as dairy products, meat and fish. Behind the lightweight sheet metal facades of these cabinets lies delicate internals—compressors, condensers, cooling coils, and associated control circuitry such as thermostats and temperature sensors—that are required to refrigerate the goods. The facade provides minimal protection, and there are many opportunities for damage. A careless shopper with a full shopping cart, or a stockboy with a heavily loaded pallet cart (which can weigh upwards of 1000 pounds), or cleaning person operating a self-propelled industrial floor cleaner, can, via one careless collision, do damage to the cabinet. Particularly vulnerable are the cooling coils, which are routed throughout the cabinet and which contain a volatile and expensive refrigerant. Even if the internals are not damaged, the appearance of the cabinet can, over time, suffer considerably. Fixtures are often designed, not as industrial fortresses, but as an aesthetically pleasing and convenient part of a total package for marketing goods. Yet protection is a must, if costly repairs are to be avoided. Similar considerations apply to less sophisticated fixtures, such as checkout counter, or even a wall. Constant bumping from a vacuum cleaner can leave dings, dents, and gouges that are unsightly, necessitating constant and tedious minor repairs.

Known in the art are protective rails installed around the periphery of a fixture or structure. These rails typically comprise a base member incorporating an abrasion-resistant plastic strip that is available in many colors for matching the surrounding color scheme. Often, floor mounted base rails are mounted approximately 5" to 8" above a floor, and are removable. Rails are not limited to installation in floors, however, and can disposed about, or attached to, a structure so as to best protect the structure from damage. For example, a rail system can be attached to a wall or other structure. Rail systems are typically modular, and may have a limited number of lengths of straight sections and of curvatures of corner sections available. A particular rail system for protecting a structure or fixture is built-up from available modular rail sections and corners. One example of a known protection system is disclosed in U.S. Pat. No. 5,149, 569, issued on Sep. 22, 1992 to David S. McCue, and herein incorporated by reference.

Corner sections of base rail systems present greater difficulties. Typically, a limited number of pre-molded corner angles are available, the most popular angle being 90 degrees. A base rail system that cannot closely conform to the contours of a fixture wastes valuable space, creates an enclosed area difficult to access, and is unduly obtrusive, thereby limiting access to the fixture and may present a tripping hazard. Similar considerations apply to a wall mounted rail system that does not readily conform to the angle at which two walls meet.

Furthermore, because the corners are the most frequently struck part of a rail system, they often abrade and become unsightly from the constant collision and scraping. Often there is a seam where the corner piece joins to straight components of the rail system. Objects scraping along the corner can catch the seam and tear the plastic covering from either the straight modular section or, if present, from the modular corner, creating a hazard to the consumer. In addition, because they protrude, corners are often directly struck and thus subject to high impact forces, damaging and necessitating replacement of the corner.

Though straight sections of existing rail system are not as troublesome as corners, there is room for improvement. The rail can be damaged, and rendered unsightly, by direct or head-on, impacts. As students of elementary physics are aware, the forces generated in stopping an object that has a given momentum are determined by the time rate change of the object's momentum. Stopping the object immediately, as when it encounters a rigid rail, results in high forces; stopping it more slowly results in lower forces, but can require letting the object travel a distance. A rigid, non-yielding rail stops a colliding object, such as a floor scrubber, quite suddenly, subjecting the rail to potentially damaging collision forces. An ideal protective rail system would include an effective cushioning, or shock absorbing, system that yields more gradually, while providing a retarding force to decelerate the colliding object less drastically. Collision forces are thus reduced. Known rail systems typically employ a tough, abrasion resistant strip attached to a base. However, such strips are often installed such that violent collisions therewith by objects can cause the strip to detach from the base, as well as damage the lightweight base and the fixture or structure that the protection system is designed to protect.

Accordingly, it is an object of the present invention to provide a robust fixture protection system that withstands collisions with objects.

It is another object of the present invention to provide a corner for a fixture protection system that is less susceptible to abrasion and damage.

Another object of the present invention is to provide a more versatile fixture protection system corner for accommodating a wider variety of fixture angles.

Yet a further object of the present invention is to provide a fixture protection system that lessens the likelihood of damage to protective members of the system or to an object that collides therewith.

SUMMARY OF THE INVENTION

The invention provides a protection system having a rotatable corner member for rotatably engaging and re-directing objects, and an improved rail protection member that includes a shock cushioning feature. The protection system can be disposed about structures or fixtures to best afford protection, and can, for example, be mounted on wall or on a floor. Optimally, both the rotatable member and the rail member according to the invention are incorporated together into a fixture or structure protection system.

However, each is an improvement and incorporating either one of them with an otherwise known system, for example, combining a rotatable corner member with existing rail protection members, is beneficial.

The rotatable member is typically a spheroidal member, and rotatably engages objects colliding with the corner, deflecting or redirecting the force of impact and the object itself. Spheroidal member, as used herein, refers to a member having a curved surface for engaging objects. The rotatable member typically protrudes beyond the impact faces of the rail protective members so as to intercept approaching objects. A collision between an object and the corner assembly generates forces tangential to the surface of the rotatable member that cause the member to rotate. Such rotation continuously varies the point of contact between the object and the rotatable member, avoiding scraping contact, and reducing unsightly damage to the corner of the fixture protection system. Furthermore, as the rotatable member rotates, it exerts a force in a direction radial to its axis of rotation on the colliding object. Thus the rotatable member can also redirect the colliding object so as to contact rail members coupled to the rotatable member at a more shallow angle (i.e., more tangentially), thus reducing the prospect of damage to the member.

A rail protection member according to the present invention includes a channel member having a resilient cover disposed about the channel member to form a cushioning system that reduces and disperses collision forces acting on the protective base rail member. The cover, or sheath, and the channel member are arranged to form a gap between an impact face of the sheath and the wall of the channel member, for gradually decelerating an object over the distance of the gap. The channel member and the sheath cooperate to disperse collision forces. The channel member provides protection against violent collisions that the shock absorber system cannot handle.

According to one aspect of the invention, a protective rail system includes two protective members each having a proximate end and a distal end along the longitudinal axis, and a rotatable corner member. The protective rail system includes means for rotatably coupling the rotatable member to the proximate ends of the first and second protective members.

In another aspect, the invention includes pivot means for allowing the first protective member to pivotally couple to the second protective member for varying the angle between the first and second longitudinal axes. The rail system can thus accommodate a variety of fixture angles. In addition, the system can be reversed so that protective member impact surfaces, or faces, that were facing inward towards a fixture now face outward, and vice versa. The useful life of the system is thus increased.

A support may be included for supporting the protective members and the rotatable corner member at a selected height above a floor, or at a selected position along a wall.

The coupling means of the protective rail apparatus may also include a corner adapter. The corner adapter typically has a first end adapted for attachment to a protective member, and a socket end for receiving the spheroidal member. Typically, the socket closely conforms to a portion of the face of the protruding spheroidal member to reduce the gap between the socket of the adapter and the spheroidal member. An object is thus unlikely to jam or collide directly with the adapter and damage the corner assembly.

The rotatable member preferably has an axle hole therethrough, and the coupling means and the pivot means include the axle hole, an axle pin, and a first pair of fingers extending from the proximate end of the first rail member. The axle pin passes through the axle hole in the rotatable member and through a hole in the end of each finger.

The spheroidal member is preferably segmented, and includes at least a first spheroidal segment spaced from a second spheroidal segment so as to form a gap therebetween. At least one of the segments is rotatable. A finger extends from a protective member and passes through the gap for rotatably coupling to the segments.

In one variation of the invention, the rotatable spheroidal member includes an upper segment spaced from a central segment, forming a first gap therebetween, and a lower segment spaced from the central segment, forming a second gap therebetween, and at least the central segment is rotatable about an axis projecting from a plane defined by the first and second longitudinal axes. The spheroidal segments have coaxial holes therethrough for accepting an axle pin. Further included are two pair of fingers, one pair of fingers extending from the proximate end of each protective rail member, each pair of fingers having coaxial holes therethrough, the upper fingers of each pair of fingers passing through the first gap and the lower fingers of each pair of fingers passing through the second gap. An axle pin is inserted through the finger and segment holes.

In yet another feature of the invention, a protective rail member includes an arcuate channel member extending along a longitudinal axis. The channel member has first and second opposing walls forming a channel therebetween, and the walls each have an inner surface facing the interior of the channel and an outer surface. Also included is an arcuate channel member sheath for covering the first channel member. The sheath is typically formed of a resilient material and has first and second sheath walls forming a channel therebetween. The first sheath wall forms a cushioning gap between the first sheath wall and the first channel member wall when the sheath is installed on the first channel member. Retaining means are included for retaining the sheath on the channel member.

The retaining means includes a pair of retaining grooves formed in the first and second sheath walls for engaging lower edges of the first and second channel member walls. The retaining means can also include a pair of opposing retaining tabs depending from the first and second opposing walls of the channel member, and a pair of a tab-engaging grooves formed in the first and second sheath walls for engaging the retaining tabs.

The foregoing and other objects, features and advantages of the invention will be apparent from the following description and the accompanying drawings, in which like reference characters refer to the same parts throughout the different views. The drawings illustrate principles of the invention and, although not to scale, show relative dimensions.

DESCRIPTION OF ILLUSTRATED EMBODIMENT

Figure 1:
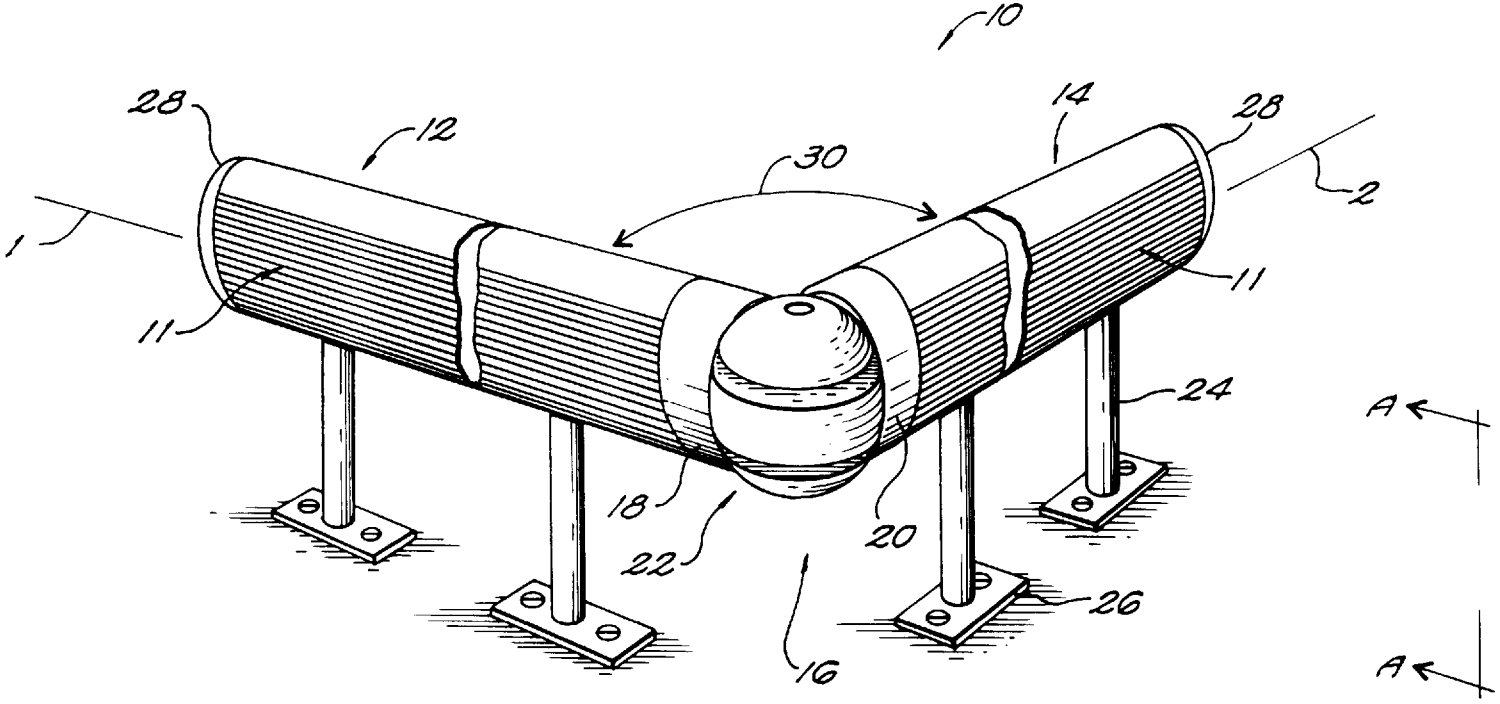
FIG. 1 is a perspective view of a protective rail system, illustrating protective rail members, a corner assembly including a rotatable member for rotatably engaging and deflecting objects, and support means for supporting the rail system.

FIG. 1 illustrates a preferred embodiment of a protective rail system 10. The protective rail system 10 includes a first protective rail member 12 extending along a first longitudinal axis 1, a second protective rail member 14 extending along a second longitudinal axis 2, and a corner assembly 16. The corner assembly 16 includes a redirecting, or rotatable, member 22 for rotatably engaging objects, such a grocery cart or floor washing machine, and re-directing the objects away from the fixture (not shown) that the base rail system protects. The corner assembly also includes one or more socket adapters, or transitions, 18 and 20 that receive the rotatable member 22 and rotatably couple it to the base rail members 12 and 14, respectively. Protective rail members 12 and 14 include impact faces 11 for receiving colliding objects. The rotatable member can 22 protrude beyond impact faces 11 for engaging objects approaching corner assembly 16. The protective members 10 and 12 are preferably terminated with end caps 28.

The rail system 10 is supported off of a floor by support means, such as the support post 24, which is in turn secured to the floor by a base plate 26. In a preferred embodiment, illustrated and discussed in accordance with FIG. 3, the support post 24 does not include the base 26, but simply slips into a receptacle in the floor, allowing the rail system to be easily removed for maintenance or for periodic cleaning of the small area of floor between the rail and the fixture the rail system 10 protects. As appreciated by one of ordinary skill in the art, the rail system 10 can be attached to a wall by a suitable support means to provide a rail system for protecting the wall. For example, posts such as post 24 can include a right angle bend such that the base 26 can be attached to a wall bag or other means known in the art.

A floor mounted rail system 10 is typically disposed about the perimeter of the fixture to be protected. In a preferred embodiment, corner assembly 16 pivotally couples the base rails 12 and 14 such that the angle 30 between longitudinal axes 1 and 2 can be adjusted to accommodate any angle.

The rotatable member 22 reduces the unsightly abrasion of the corner assembly 16 that can result from repeated collisions, in part because the point of contact of the rotatable member 22 and an object colliding therewith changes as the object causes the rotatable member 22 to rotate. Furthermore, collision forces on the protective rail system, including the corner assembly 16, are reduced as the rotatable member 22 redirects an approaching object.

Figure 2:
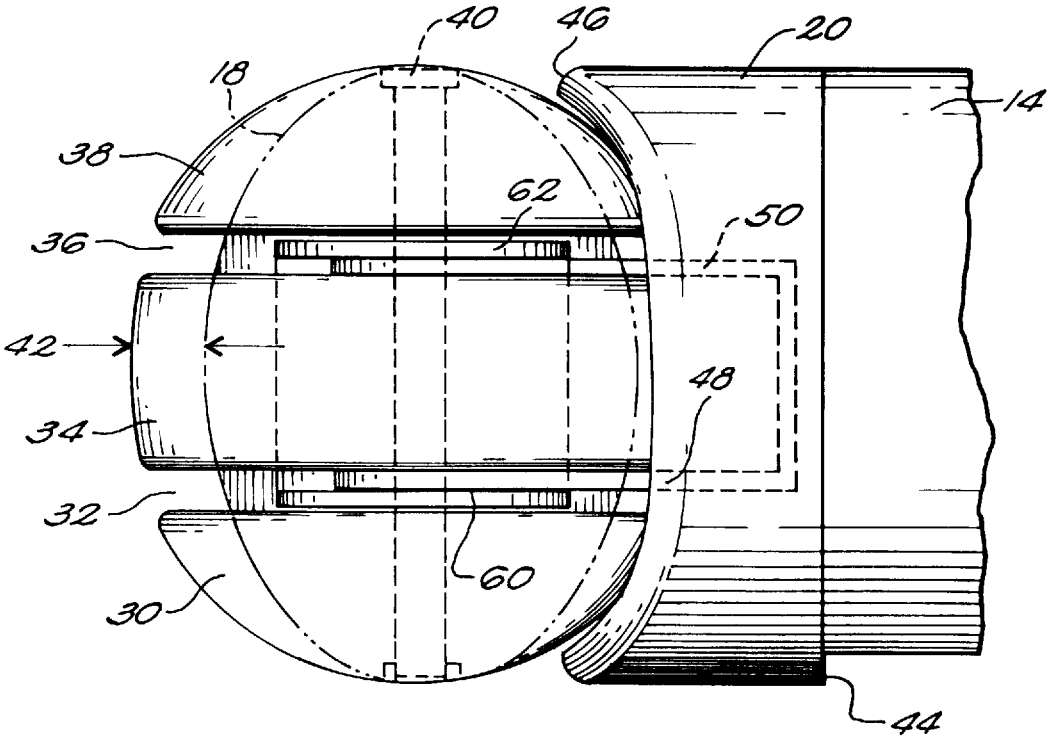
FIG. 2 is a side elevation of a preferred embodiment of a corner assembly of the protective base rail system of FIG. 1.

FIG. 2 is a view of the protective rail system 10 taken along line A—A in FIG. 1, illustrating the corner assembly 16. In a preferred embodiment, rotatable member 22 includes a lower segment 30, a center segment 34, and an upper segment 38. The lower segment 30 is spaced from the center segment 34 so as to form a lower gap 32, and the center segment 34 is spaced from the upper segment 38 so as to form an upper gap 36. The lower segment 30, the center segment 34 and the upper segment 38 are shaped such that, taken together, they form an spheroidal member, such as a sphere. The segments 30, 34, and 38 each have an axle hole therethrough, through which axle pin 40 is inserted. Thus each of segments 30, 34, and 38 is independently rotatable about the axle pin 40. However, not all of the segments 30, 34 and 38 need to be rotatable.

The socket adapter 20 includes a first end 44, adapted for mating with the second protective member 14, and a socket end 46, adapted to receive the Spheroidal segments 30, 34 and 38. Protruding from the socket end 46 of socket adapter 20 are a pair of fingers, comprising lower finger 48 and upper finger 50, for rotationally coupling the rotatable member 22 to protective members 12 and 14, and for pivotally coupling protective members 12 and 14 to each other. Another pair of fingers, 52 and 54, extend from the socket end, shown in outline in FIG. 2, of socket adapter 18. The fingers 48, 50, 60 and 62 typically each have a hole, coaxial with the holes or channels through spheroidal segments 30, 34 and 38, for the axle pin 40 to pass through. Rotationally coupling, as used herein, refers to the provision for rotational movement of the rotatable member 22; pivotally coupling refers to the first adapter 18 being pivotable with respect to the second adapter 20 such that the angle 30 in FIG. 1 between the first longitudinal axis 1 and the second longitudinal axis 2 can be varied.

Pivotal coupling is independent of rotational coupling. For example, the corner assembly 16 can be designed so as to rotatably couple the rotary member 22 to the fixture protector system 10, but not pivotally couple the protective members 12 and 14 to each other. For example, the fingers 48 and 50 can be welded to the axle pin 42, fixing the angle 30 in FIG. 1 between the first protective member 12 and the second protective member 14. However, welding the fingers 48, 50, 60 and 62 to the axle pin 40 does not prevent rotation of the spheroidal segments 30, 34, and 38 about the axle pin 40.

Note that the center segment 34 preferably is sized to protrude, as illustrated by reference numeral 42, beyond the impact face 11 illustrated in outline in FIG. 2. Thus an object approaching the corner assembly 16 is deflected away from engaging the protective member 12, particularly the socket end 46 of a socket adapter 20. Prior art corner assemblies included seams that could more readily be engaged by an object. The socket end 46 of socket adapter 20 is preferably shaped to closely receive the spheroidal members 30, 34 and 38, thus reducing any gap between the spheroidal members 30, 34 and 38 and socket end 46 to a minimum, and minimizing the possibility of an object directly colliding with the socket end of a socket adapter in a manner likely to cause damage. Deflection of an approaching object by the rotatable member also creates a more shallow angle of impact between the object and protective members, such as protective members 12 and 14, of the rail protection system 10, thus reducing damaging collision forces. The corner assembly 16 cooperates with a shock absorber system (described subsequently herein) of the protective members 12 and 14 to reduce damage to the fixture protection system 10. Thus objects approaching the corner assembly 16 are deflected, or redirected, to more tangentially impact the impact faces 11, reducing forces on the faces 11 such that the forces are more readily dealt with by a shock absorbing system of protective members 12 and 14. Because the corner assembly 16 rotatably engages objects, abrasion of the corner assembly 16 is reduced.

The rotatable member 22 may be formed from a variety of material, including, but not limited to rubber, ABS plastic, polypropylene plastic, and PVC plastic.

Figure 3:
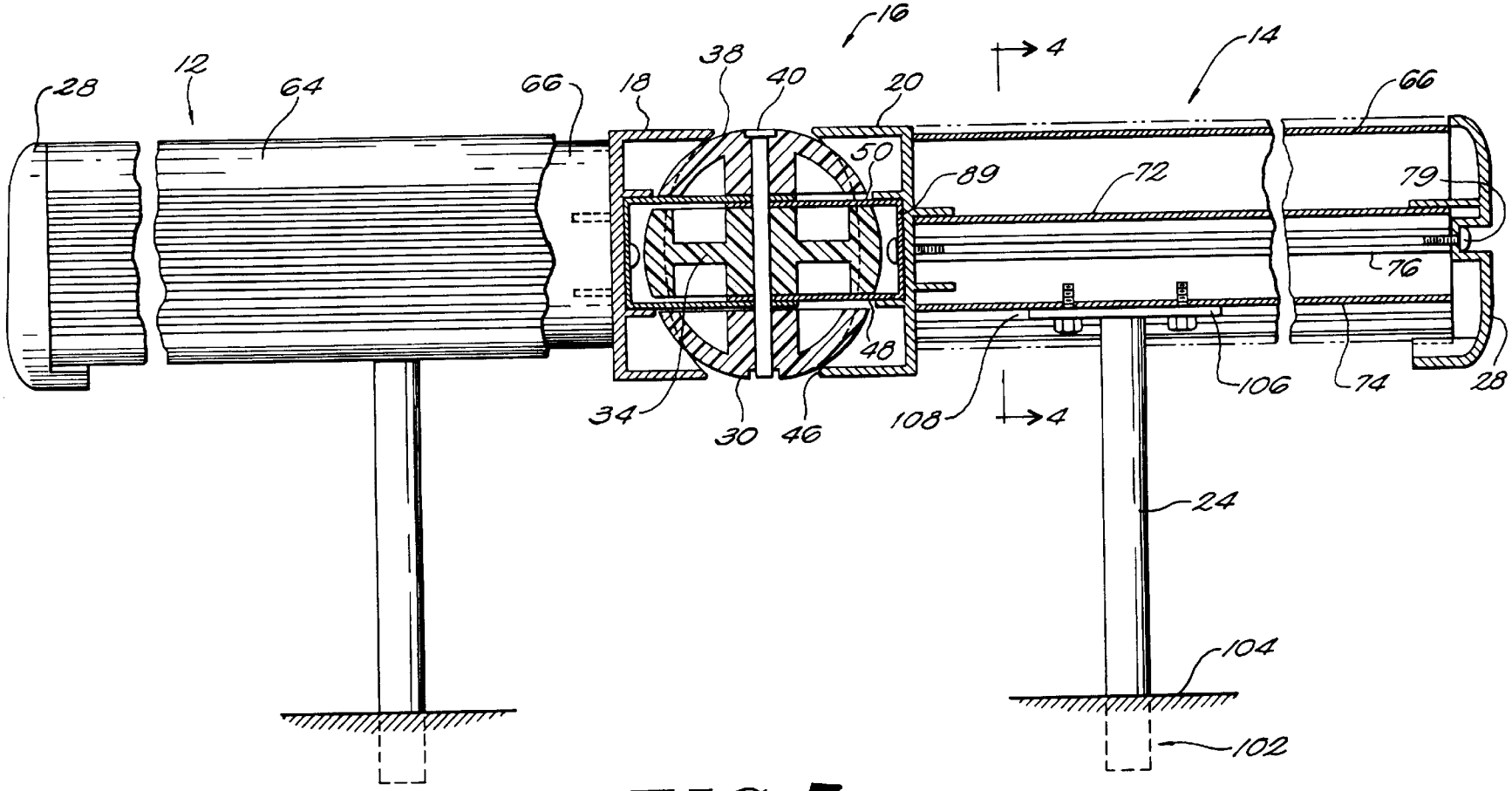
FIG. 3 is a longitudinal elevation, partially cutaway, of the protective base rail system of FIG. 1, including a cutaway view of the corner assembly and of one of the protective base rail members.

FIG. 3 is a longitudinal elevation, partially cutaway, of the protective rail system 10 of FIG. 1, further illustrating the protective rail members 12 and 14, and the corner assembly 16. FIG. 3 is first discussed in conjunction with FIG. 4, which is a cross section taken along section lines 4—4 in FIG. 3, to illustrate the components of the protective base rail members 12 and 14. FIG. 3 is subsequently discussed in conjunction with FIGS. 5 and 6 to illustrate additional design details of the corner assembly 16.

Figure 4:
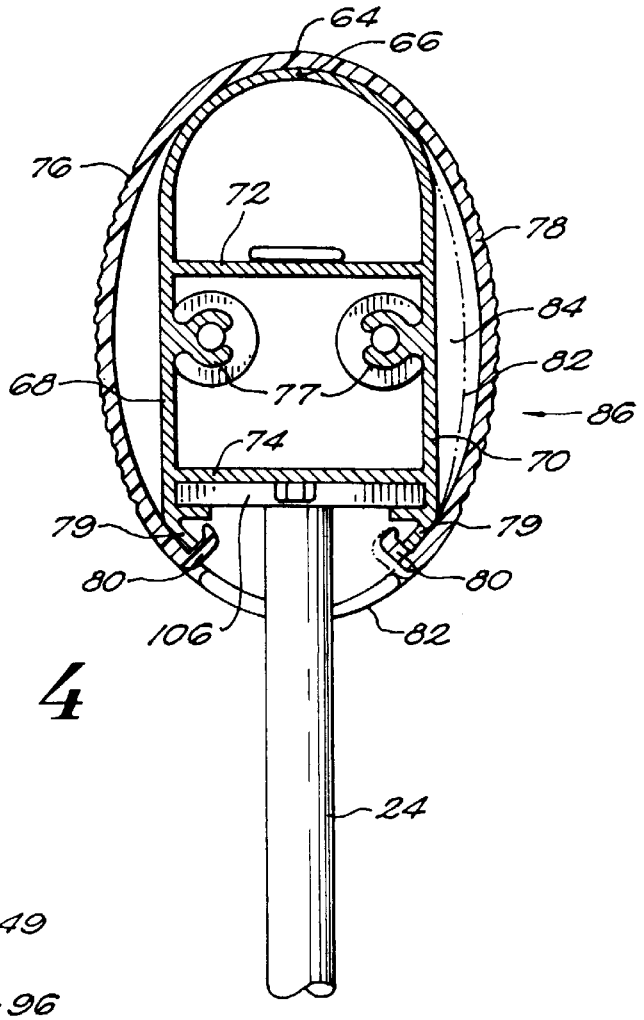
FIG. 4 is a cross section of a protective rail member taken along section line 4—4 in FIG. 3, depicting an arcuate channel member, protective sheathing, an end cap, and a support post.

With reference to FIGS. 3 and 4, the protective member 12 include a resilient sheath 64 covering a channel member 66. The channel member 66 can be extruded aluminum, or other materials, such as formed steel or a plastic such as PVC, an ABS plastic, or polypropylene. Acceptable materials for the sheath include PVC plastic, ABS plastic, or polypropylene, though PVC is the preferred material. The sheath 64 and channel member 66 can be formed using an extrusion process. In a preferred embodiment, the channel member 66 is arcuate and includes first and second opposing walls, 68 and 70, respectively, and an upper transverse member 72 and a lower transverse member 74. Shoulders 77, having a hole or slot extending therethrough, depend from inner surfaces of the arcuate channel member walls 68 and 70, and run the length of the arcuate channel member, as illustrated in FIG. 3. Screws 79 or other securing means fasten the end caps 28 to the arcuate channel member 66 by screwing into the slots in the shoulders 77. The resilient sheath 64 is preferably also arcuate, and includes first and second opposing sheath walls 76 and 78, respectively, and also includes tab-retaining grooves 80 formed in the lower edges of the first and second sheath walls 76 and 80. The grooves 80 engage the tabs 78 formed in the lower portions of arcuate channel member opposing walls 68 and 70, and serve to retain the sheath 64 on the arcuate channel member 66.

The first and second opposing sheath walls, 76 and 78, are spaced, respectively, from the first and second arcuate channel member walls 68 and 70, to form a cushioning gap, such as the gap 84, therebetween. An impact on impact face 11, along an impact axis 86, stresses the resilient sheath, causing the second sheath wall to bend inward, such as to a position approximately represented by the broken line 82. The flexing of sheath 64 under the impact creates a restoring force that opposes the impact and that typically increases as the gap 84 is reduced, tending to more gradually decelerate the object colliding with the sheath. The flexing of the sheath also tends to disperse the forces applied to the accurate channel member 66. The impact axis 86 is generally transverse to impact face 11 and to longitudinal axes 1 and 2. The sheath 64, arcuate channel member 66 and gap 84 function as a shock absorbing and force dispersal system to reduce damage to the protective rail system 10 and to the object colliding therewith. However, the channel member is sufficiently strong to handle violent collisions that full compress the gap 84 without damage to the channel member 66 or the fixture or structure it protects. The end cap 28, partially visible in FIG. 4, includes a retaining stop 82, for limiting travel of the retaining grooves 80 when the sheath member 64 is stressed due to an impact. Limiting the travel of the grooves 80 helps avoid the sheath 64 separating from the accurate channel member 66 as a result of an impact. The sheath 64 and the channel member 66 need not be arcuate to form a cushioning gap 84 therebetween, but the arcuate shaping of the sheath 64 and the channel member 66 helps reduce stress on the sheath 66 due to an impact with an object and helps disperse collision forces, as well as retain sheath 66 on channel member 64.

Figure 5:
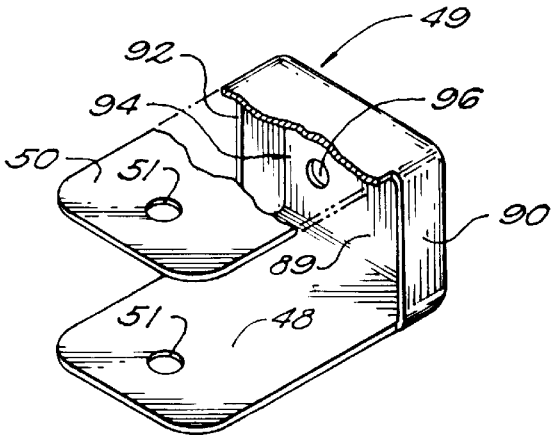
FIG. 5 is a cutaway pictorial view of a support bracket for coupling to the rotatable member of FIGS. 2 and 3, illustrating the finger base support bracket, upper and lower fingers, and left and right strengthening members that in conjunction with the fingers form a strengthening well adjacent the base.
Figure 6:
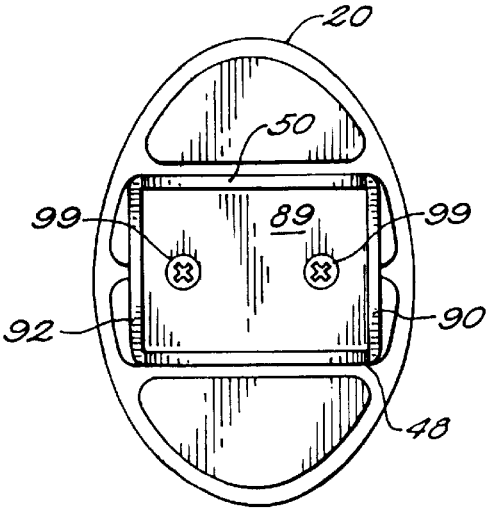
FIG. 6 is an elevational end view of a socket adapter for receiving and coupling the rotatable member to a protective rail member.

Referring now to FIG. 3 in conjunction with FIGS. 5 and 6, parallel fingers 48 and 50 extend from the socket end 46 of the adapter 20, and have holes therethrough (51 in FIG. 5) for receiving axle pin 40. Typically, fingers 48 and 50 extend outward from a base 89 of the mounting bracket 49, as illustrated in FIG. 5. In a preferred embodiment, parallel strengthening members 90 and 92 also extend outward from base 89 and are connected, preferably by welding, to fingers 48 and 50, as illustrated in FIG. 5, to form a strengthening well 94. The mounting bracket 49 is typically stainless steel and has been found to enhance the strength of corner assembly 16 appreciably. FIG. 6 is a illustrates elevational view of socket adapter 20, viewing the socket end 46. Fasteners, such as screws 99, fasten the mounting bracket 49 and socket adapter 20 together and to arcuate channel member 66 by engaging the grooves in the slotted shoulder 77.

FIG. 3 also depicts a technique for mounting the protective base rail system to a floor. Post 24 inserts into a hole 102 in the floor 104, facilitating removal of the base rail system. Typically, an insert (not shown) is glued into hole 102 for receiving post 24. The post 24 includes an upper bracket 106 for engaging slots 108 formed in the lower portions of channel member walls 68 and 70, an just above retaining tabs 79.

Figure 7A:
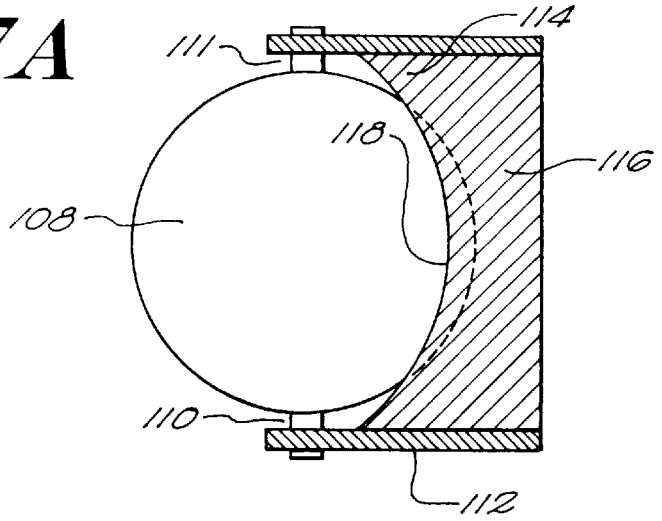
FIGS. 7A–7C illustrate alternative embodiments of a corner assembly for use with a protective base rail system.

FIG. 7A illustrates an alternative embodiment of the corner assembly 16. For simplicity of illustration, only one socket adapter, socket adapter 116, is depicted. In FIG. 7A, a non-segmented spheroidal rotatable member 108, such as a solid sphere, includes integral axle nubs 110 and 111 for insertion into holes (not shown) in lower and upper fingers 112 and 114 respectively. Socket adapter member 116 includes a socket end 118 adapted to receive rotatable member 108, and a first end for coupling to a protective rail member (not shown). Note that an axle pin, inserted in an axle hole through rotatable member 110, can be used to engage lower and upper fingers 112 and 114, rather than integral nubs 110 and 111.

Figure 7B:
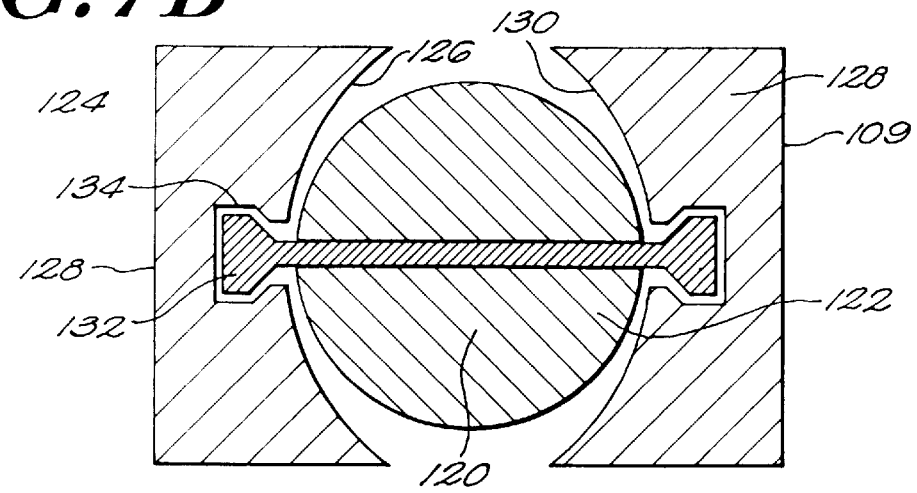

FIG. 7B illustrates a longitudinal elevation of an embodiment of corner assembly 16 that does not use an axle pin, integral nubs, or a pair of fingers to rotatably and pivotably couple the sphere to the protective base rail members 124 and 128. Socket adapters 124 and 128 include first ends 125 and 129, respectively, for coupling to protective base rail members, (not shown) and socket ends 126 and 130, respectively for receiving and pivotally and rotatably coupling to the rotatable member 120. Rotatable member 120 includes an integral circumferential extension 122 that has a key-like outer portion 132 to engage matching cutouts, such as cutout 134, in the socket ends 126 and 130 of socket adapters 124 and 128.

Figure 7C:
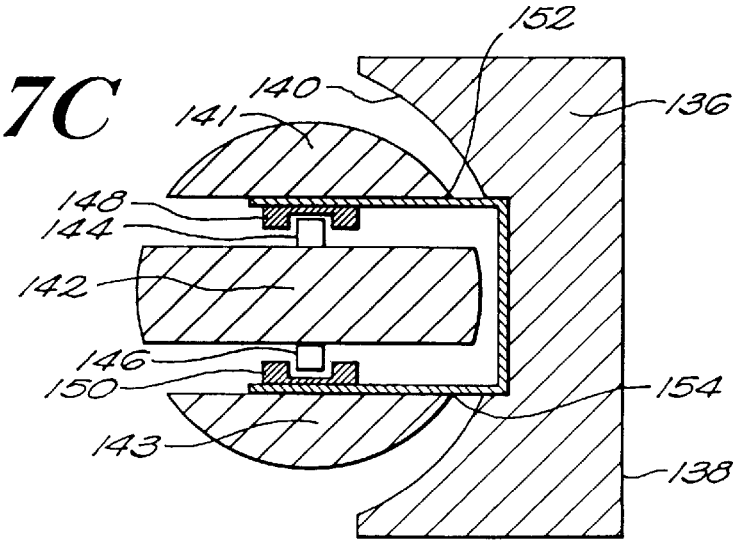

FIG. 7C illustrates an embodiment of a corner assembly which also does not use an axle pin. For simplicity of illustration, only one socket adapter, socket adapter 136, is shown. Socket adapter 136 includes a first end 138 adapted to couple to a protective base rail (not shown) and a socket end for receiving segments redirecting segments 141, 142, and 143, of which only center segment 142 rotates. The center segment includes integral nubs 144 and 146 that engage receptacles 148 and 150, which are integral with segments 141 and 143, respectively. Fingers 152 and 154 extend from socket end 140 of adapter 136, and have holes therethrough (not shown) for press fitting over the outer diameter of receptacles 148 and 150.

The invention advantageously rotatably and pivotally couples a is rotatable member, such as spheroid, to a protective base rail system. Abrasion of the corner assembly of the fixture protection system, and collision forces on the system are reduced, as is the likelihood of an object engaging a seam so as to damage a corner assembly. The corner assembly accommodates many fixture angles, and allow the fixture protection system to be reversed, extending the useful life thereof. The fixture protection system also incorporates a shock absorbing system for damaging collision forces.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

What is claimed is:

1. Protective rail device, comprising a) a first protective member extending along a first longitudinal axis and having a proximate end and a distal end along said first axis, said first protective member including a first arcuate channel member extending along a first longitudinal axis, said channel member having first and second opposing walls forming a channel therebetween, said walls each having an inner surface facing the interior of said channel and an outer surface, a first arcuate channel member sheath for covering said first channel member, said first sheath being formed of a resilient material and having first and second sheath walls forming a channel therebetween, said first sheath wall arranged for forming a cushioning gap between said first sheath wall and said first channel member wall when said sheath is installed on said first channel member, and a first retaining means for retaining said first sheath on said channel member, b) a second protective member extending along a second longitudinal axis and having a proximate end and a distal end along said second axis, said second protective member including a second arcuate channel member extending along a second longitudinal axis, said second channel member having first and second opposing walls forming a channel therebetween, said walls each having an inner surface facing the interior of said channel and an outer surface, a second arcuate channel member sheath for covering said second channel member, said second sheath being formed of a resilient material and having first and second sheath walls forming a channel therebetween, said first sheath wall arranged for forming a cushioning gap between said first sheath wall and said first channel member wall when said sheath is installed on said first channel member, and a second retaining means for retaining said second sheath on said channel member, and c) corner means, said corner means including rotatable means for temporarily rotatably engaging an object, and coupling means for coupling said rotatable means to said proximate ends of said first and second protective members.

2. The protective rail device of claim 1 wherein said corner means includes pivot means pivotally coupling said first protective member to second proximate member and adapted for varying the angle defined by the intersection of said first and second longitudinal axes.

3. The protective rail device of claim 1 including support means for supporting said protective members at a selected height above a floor.

4. The protective rail device of claim 1 wherein said rotatable means comprises a spheroidal rotatable member and wherein said channel members each include an impact face, and wherein said spheroidal member is arranged to protrude beyond said impact faces.

5. The protective rail device of claim 4 wherein said coupling means includes socket means for receiving said spheroidal member.

6. The protective rail device of claim 4 wherein said socket means includes a first end adapted to mate with a protective rail member and a second socket end for closely receiving said spheroidal member.

7. The protective rail device of claim 4 wherein said spheroidal member is formed of at least one plastic material selected from the group consisting of a polyvinyl chloride plastic, an ABS plastic, and a polypropylene plastic.

8. The protective rail device of claim 4 wherein said spheroidal member is formed of at least one material including rubber.

9. The protective rail device of claim 4 wherein said spheroidal member is formed of at least one material including a metal.

10. The protective rail device of claim 4 wherein said spheroid comprises an axial channel for pivotably engaging said coupling means, said coupling means comprising an axle pin, and a first pair of fingers extending from the proximate end of said first rail member, said pair of fingers having a pair of coaxial holes therethrough for receiving said axle pin and arranged for securing said spheroid therebetween.

11. The protective rail device of claim 4 wherein said spheroidal member comprises at least a first spheroidal segment and a second spheroidal segment, wherein one of said segments is rotatable about said axis.

12. The protective rail device of claim 11 wherein said first and second spheroidal segments are spaced to form a gap therebetween, said segments having coaxial channels therethrough, said proximate ends of said protective members each having a finger extending therefrom for passage through said gap, said fingers each having an annulus therethrough, and an axle pin for insertion through said annuli and channels for securing said segments between said fingers.

13. The protective rail device of claim 4 wherein said spheroidal member includes an upper segment spaced apart from a central segment, forming a first gap therebetween, and a lower segment spaced apart from said central segment, forming a second gap therebetween, and wherein at least said central segment is rotatable about an axis projecting from a plane defined by said first and second longitudinal axes, said spheroidal segments having coaxial holes therethrough, and wherein said protective base rail device includes two pair of fingers, one pair of fingers extending from the proximate end of each rail member, each pair of fingers having coaxial holes therethrough, the upper fingers of each pair of fingers passing through said first gap and the lower fingers of each pair of fingers passing through said second gap, and an axle pin for insertion through said coaxial holes in said segments and in said fingers.

14. A corner assembly for use with a fixture protection system that includes first and second protective rail members, said corner assembly comprising a rotatable spheroidal member, a pair of socket adapters, each of said pair of socket adapters having a first end adapted to mate with one of said first and second protective rail members of said fixture protection system and having a socket end for receiving said spheroid, and means for rotatably coupling said spheroid to said socket adapters.

15. The corner assembly of claim 14 including means for pivotally coupling said pair of socket adapters.

16. The corner assembly of claim 15 wherein each of said first and second protective rail members have impact faces, and said rotatable member protrudes beyond the impact faces of said protective members.

17. The corner assembly of claim 14 wherein said spheroidal member is formed of at least one plastic material selected from the group consisting of a polyvinyl chloride plastic, an ABS plastic, and a polypropylene plastic.

18. The corner assembly of claim 14 wherein said spheroidal member is formed of at least one material including rubber.

19. The corner assembly of claim 14 wherein said socket ends of said socket adapters are configured for closely receiving said rotatable member.

20. The corner assembly of claim 14 wherein said rotatable member comprises a segmented spheroid having at least two sections, at least one of said sections being rotatable, wherein said sections are spaced so as to form gap therebetween, and at least one of said sections having an axle hole therethrough, an axle pin for insertion through said axle hole such that said rotatable member is rotatably interfit between said socket adapters and secured therebetween by said axle pin, and each of said socket ends of said pair of socket adapters including a finger extending therefrom for passing through said gap, said fingers including means for rotationally coupling to at least one of said spheroid segments.

21. The corner assembly of claim 20 wherein said means for rotatably coupling to said spheroid comprises means for securing said axle hole to said finger.

22. A corner assembly for use with a fixture protection system that includes protective rail members, comprising an axle pin, a rotatable member adapted for rotation about said axle pin, said rotatable member including an upper segment spaced from a central segment, forming a first gap therebetween, and a lower segment spaced from said central segment, forming a second gap therebetween, and wherein at least said central segment is rotatable, a pair of adapters, each adapter having a first end for coupling to said fixture protection system and a socket end for receiving said rotatable member, said socket ends each including a pair of parallel fingers extending therefrom, an upper of each pair of parallel fingers passing though said first gap and a lower of each pair of parallel fingers passing through said second gap in said rotatable member, said pairs of parallel fingers in said rotatable member being adapted for coupling to said axle pin and securing said rotatable member to said fixture protection system.

23. The corner assembly of claim 22 including a finger base, said parallel fingers comprising a pair of planar members outwardly extending from said finger base, and a parallel pair of outwardly extending strengthening members connected to said fingers and to said finger base, said pairs of strengthening members and pairs of fingers forming a strengthening well adjacent said base, and attachment means for attaching said base to said socket end of said adapter.

24. Protective base rail device comprising, a first arcuate channel member extending along a first longitudinal axis, said channel member having first and second opposing walls forming a channel therebetween, said walls each having an inner surface facing the interior of said channel and an outer surface, a first arcuate channel member sheath for covering said first channel member, said first sheath being formed of a resilient material and having first and second sheath walls forming a channel therebetween, said first sheath wall arranged for forming a cushioning gap between said first sheath wall and said first channel member wall when said sheath is installed on said first channel member, and retaining means for retaining said sheath on said channel member.

25. The protective base rail member of claim 24 wherein said retaining means comprises a pair of retaining grooves formed on said first and second sheath walls for engaging lower edges of said first and second channel member walls.

26. The protective base rail member of claim 24 wherein said retaining means comprises a pair of opposing retaining tabs in said sheath depending from said first and second opposing walls of said channel member sheath, and a pair of tab-engaging grooves in channel formed in said first and second sheath walls for engaging said retaining tabs.

27. The protective base rail device of claim 26 including means for pivotally coupling said socket adapters for varying the angle between said first longitudinal axis and said second longitudinal axis.

28. The protective base rail device of claim 24 including

A second arcuate channel member extending along a second longitudinal axis, said second channel member having first and second opposing walls forming a channel therebetween, said walls each having an inner surface facing the interior of said channel and an outer surface, a second arcuate channel member sheath for covering said second channel member, said second sheath being formed of a resilient material and having first and second sheath walls forming a channel therebetween, said first sheath wall forming a cushioning gap between said first sheath wall and said first channel member wall when said sheath is installed on said first channel member, second retaining means for retaining said second sheath on said channel member, a corner assembly for coupling to said first and second arcuate channel members, comprising a rotatable spheroidal member, a first socket adapter having a first end adapted to mate with said first arcuate channel member and a socket end for receiving said spheroidal member, and a second socket adapter having a first end adapted to mate with said second arcuate channel member and a socket end for receiving said spheroidal member, and means for rotatably coupling said spheroidal member to said socket adapters.

29. The protective base rail device of claim 24 wherein said channel member is formed of at least one material including extruded aluminum.

30. The protective base rail device of claim 24 wherein said channel member is formed of at least one material including steel.

31. The protective base rail device of claim 24 wherein said channel member is formed of at least one material including a plastic.

32. The protective base rail device of claim 24 wherein said sheath is formed of at least one material including polyvinyl chloride.

33. The protective base rail device of claim 24 wherein said sheath is formed of at least one material selected from the group consisting of a polyvinyl chloride material, a polypropylene material, and an ABS plastic material.

* * * * *